US009434521B2

(12) United States Patent
Olsen

(10) Patent No.: US 9,434,521 B2
(45) Date of Patent: Sep. 6, 2016

(54) CONTAINER CARRIER

(75) Inventor: Robert C. Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 1055 days.

(21) Appl. No.: 13/092,347

(22) Filed: Apr. 22, 2011

(65) Prior Publication Data

US 2011/0259767 A1 Oct. 27, 2011

Related U.S. Application Data

(63) Continuation-in-part of application No. 12/617,423, filed on Nov. 12, 2009, now Pat. No. 8,418,844.

(60) Provisional application No. 61/119,968, filed on Dec. 4, 2008.

(51) Int. Cl.
*B65D 71/50* (2006.01)
*B65D 85/67* (2006.01)

(52) U.S. Cl.
CPC ..... *B65D 71/504* (2013.01); *B65D 85/67* (2013.01)

(58) Field of Classification Search
USPC ..... 206/150, 151, 446, 427, 428; 294/87.2
See application file for complete search history.

(56) References Cited

U.S. PATENT DOCUMENTS

| | | | | |
|---|---|---|---|---|
| 3,285,405 | A | 11/1966 | Wanderer | |
| 3,778,096 | A | 12/1973 | Smith | |
| 3,830,361 | A * | 8/1974 | Klygis | 206/150 |
| 3,917,276 | A * | 11/1975 | Green Barg | 273/139 |
| 3,938,656 | A | 2/1976 | Owen | |
| 4,752,001 | A * | 6/1988 | Olsen | 206/150 |
| 5,038,928 | A | 8/1991 | Marco et al. | |
| 5,072,829 | A | 12/1991 | Marco et al. | |
| 5,255,780 | A | 10/1993 | Olsen | |
| 5,511,656 | A | 4/1996 | Olsen | |
| 6,056,115 | A * | 5/2000 | Olsen | 206/150 |
| 6,068,125 | A | 5/2000 | Slaters, Jr. et al. | |
| 6,170,652 | B1 * | 1/2001 | Olsen | 206/150 |
| 6,230,880 | B1 * | 5/2001 | Marco et al. | 206/150 |
| 7,195,809 | B2 * | 3/2007 | Weaver et al. | 428/131 |
| 2007/0193889 | A1 * | 8/2007 | Olsen et al. | 206/150 |
| 2009/0057354 | A1 | 3/2009 | Marco et al. | |
| 2010/0140121 | A1 | 6/2010 | Slaters, Jr. et al. | |

* cited by examiner

*Primary Examiner* — Anthony Stashick
*Assistant Examiner* — Blaine Neway
(74) *Attorney, Agent, or Firm* — Pauley Erickson & Kottis

(57) ABSTRACT

A generally continuous string of container carriers typically forming a package of fan-folded container carriers wherein the generally continuous string of container carriers include a flexible web forming a plurality of container receiving apertures arranged in longitudinal rows and transverse ranks defining a single container carrier. Each container receiving aperture in an inner rank includes a different length than each container receiving aperture in an outer rank and a generally triangular shape having a generally arcuate base and a pair of concave sides that taper toward a center.

12 Claims, 2 Drawing Sheets

CONTAINER CARRIER

CROSS REFERENCE TO RELATED APPLICATION

This patent application is a continuation-in-part of U.S. patent application Ser. No. 12/617,423, filed on 12 Nov. 2009. The parent U.S. patent application is hereby incorporated by reference herein in its entirety and is made a part hereof, including but not limited to those portions which specifically appear hereinafter.

BACKGROUND OF THE INVENTION

1. Field of the Invention

This invention relates to a container carrier for unitizing a plurality of containers.

2. Description of Prior Art

Container carriers are used to unitize a plurality of containers. Typical containers are bottles, cans and other containers having a sidewall and a neck, chime or raised rib around an upper portion of the container. Container carriers typically connect two or more containers into a sturdy unitized package of containers. Container carriers are generally planar arrays of rings, sometimes referred to as "six-pack carriers," and may be formed from a thermoplastic sheet material.

The thermoplastic sheet material is typically extruded and then punched so that large numbers of container carriers are formed end to end resulting in continuous elongated strings or strips of container carriers. Unless specified otherwise, container carriers as used in this specification are defined as the continuous elongated string of container carriers prior to application onto containers and subsequent division into individual container carriers.

Prior art methods of packaging container carriers involve accumulating the elongated strings of container carriers onto reels. The reels of container carriers are unwound at a later time during application onto containers. The reel method of storing and applying the container carriers to containers requires splicing the end of one reel with the beginning of the following reel without interrupting the application process. In addition, the reel method of storing and applying carriers is generally limited to reels of a size which may be physically lifted and manipulated by the applicating machine operator. Also, the reel unwinding equipment must accommodate the inertia and resultant backlash inherent in unwinding a wound strip of material. Further, the generally circular or octagonal shape of the reels limits the number of reels which may be assembled onto a single pallet for shipment between the production facility and the application facility.

Wanderer, U.S. Pat. No. 3,285,405, and Slaters Jr. et al., U.S. Pat. No. 6,068,125, incorporated by reference herein, disclose methods for storing and dispensing container carriers wherein elongated strings of container carriers are fan folded, similar to pin-feed computer paper, into boxes or cartons. The container carriers are dispensed from the boxes or cartons during the application process and successive boxes or cartons containing stacks of container carriers are spliced together as the boxes empty.

However, such methods for storing and dispensing container carriers may lead to uneven accumulation of the container carriers at each end of the box or carton, specifically where the container carriers are folded over onto each other. More particularly, when the container carrier includes a handle, a panel or some other extraneous feature, uneven stacking and/or unwinding is even more problematic. As a result, cartons may suffer from uneven stacks of folded container carriers whereby a central portion of the carton is not filled to capacity and end portions of the carton include distinctly higher stacks of carriers. This problem is referred to as "birdsnesting" and may result in inefficiently packed cartons of container carriers and even tangling of the string of container carriers during the unwinding process.

SUMMARY OF THE INVENTION

This invention provides a package of container carriers which allows for space-efficient storage of stacks of container carriers and permits uninterrupted removal of a mostly continuous elongated strip of container carriers.

A package of container carriers for shipment and storage and subsequent application to groups of containers is constructed to contain fan folded stacks of container carriers. Elongated strips of container carriers are fan folded, like pin-feed computer paper, into a plurality of stacks of container carriers.

The container carrier as described herein is preferably configured to maximize the generally flat and continuous folding of the container carriers. In this manner, a stack of container carriers may be fan folded without unequal accumulation, birdsnesting or otherwise tangling container carriers as they are moved to or from the package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
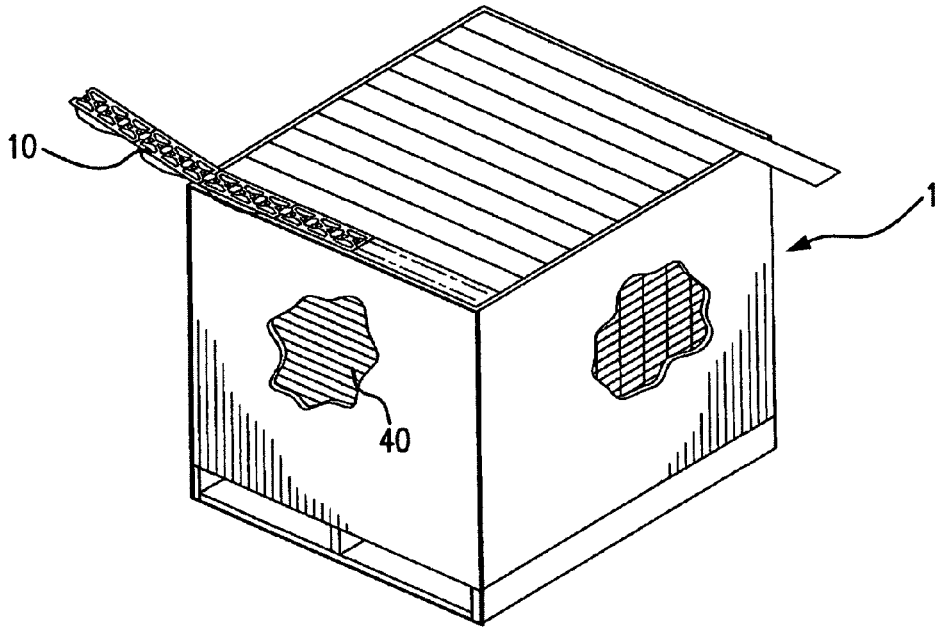
FIG. 1 is a side perspective view of a carton or package of container carriers according to one preferred embodiment of this invention.
Figure 2:
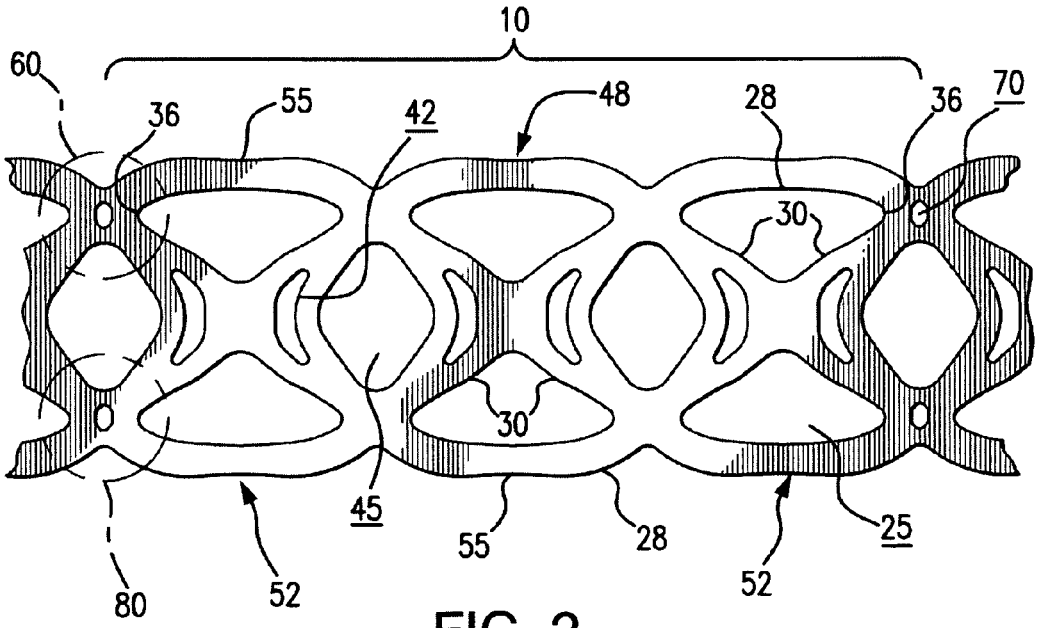
FIG. 2 is a side elevational view of a string of container carriers according to one preferred embodiment of this invention.
Figure 3:
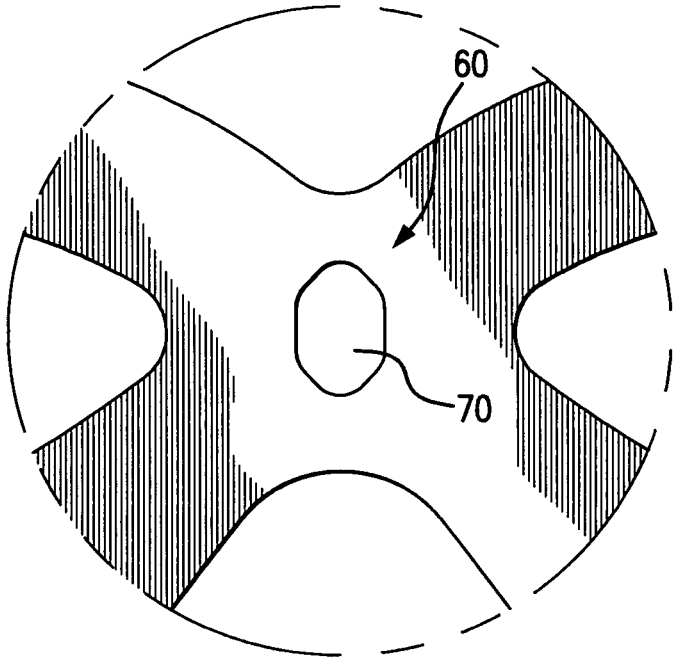
FIG. 3 is a close up view of a portion of the string of container carriers shown in FIG. 2.

FIGS. 1-3 variously show container carriers 10 as the term is used in the claimed invention. Container carriers 10 are preferably arranged in a generally continuous elongated string or strip having divisible attachment areas 60, 80 between adjacent individual container carriers. According to a preferred embodiment of this invention, container carriers 10 comprise a single layer of material.

Problems resulting from fan folding container carriers include "birdsnesting" whereby stacks 40 of container carriers 10 are unevenly accumulated, for instance, the folded edges of stack 40 are higher than a central portion of stack 40. This condition may cause problems in drawing the generally continuous string of container carriers 10 from package 1, including tangling and buckling of stack 40. As a result, container carriers 10 may break before arriving at an applicating machine or as it enters a feed trough of the applicating machine. The single layer container carrier 10 may be more prone to birdsnesting and improper breaking or separation during unwinding and/or application.

FIG. 1 shows package 1 of container carriers 10 according to one preferred embodiment of this invention. During the production process, container carriers 10 are preferably formed in the generally continuous, elongated string for shipment and storage in packaging, such as carton or package 1. After shipment to an application facility, such as a soft drink bottler, container carriers 10 are preferably removed from the packaging and applied, on an applicating machine, to groups of containers, such as cans, during which application container carriers 10 are separated from the elongated strip and into individual container carrier packages.

According to a preferred embodiment of this invention, such as shown in FIG. 2, container carriers 10 include a plurality of container receiving apertures 25 for engaging a plurality of containers to form a multipackage. Container carriers 10 preferably include a flexible web forming a plurality of container receiving apertures 25 arranged in longitudinal rows and transverse ranks. As shown in FIG. 2, two longitudinal rows of three transverse ranks form a single container carrier 10 within a string of generally continuous container carriers 10. As such, each container carrier 10 in this configuration includes an inner rank 48 and a pair of outer ranks 52. In alternate configurations, container carrier 10 may include multiple inner ranks 48 but will necessarily include two outer ranks 52, one at each end of container carrier 10.

Within the continuous string of container carriers 10, container receiving apertures 25 are preferably spaced at a non-uniform pitch, that is, a non-uniform distance between a midpoint of each adjacent container receiving aperture 25. As a result, each container receiving aperture 25 in an inner rank 48 includes a different length than each container receiving aperture 25 in an outer rank 52. In addition, each container receiving aperture 25 includes a generally triangular shape having a generally arcuate base 28 and a pair of concave sides 30 that taper toward a center.

In order to optimize foldability and application characteristics around the desired containers, container carrier 10 preferably additionally includes a flat segment 36 formed in an outer corner of each container receiving aperture 25 in the outer rank. Further, container carrier 10 may include a reduced width of the flexible web along outer bands of each container receiving aperture 25.

Container carrier 10 preferably further includes a generally diamond shaped intermediate aperture 45 formed in the flexible web between each rank of the transverse ranks of container receiving apertures 25. In addition, a generally crescent shaped grasping aperture 42 is preferably formed in the flexible web on each side of each intermediate aperture 45. This arrangement preferably facilitates carrying the multipackage of containers following application of container carrier 10 to the containers.

Preferably, a generally continuous string of container carriers is formed that includes first attachment area 60 and second attachment area 80 formed between each adjacent container carrier 10. First and second attachment areas 60, 80 preferably include dividing aperture 70 formed at least partially across each of first attachment area 60 and second attachment area 80, specifically at an outer longitudinal extremity of each container receiving aperture 25 of the outer rank 52. According to a preferred embodiment of this invention, dividing aperture 70 is generally oval shaped having two tapered ends. The two tapered ends may taper to a point or a small radius, as best shown in magnification in FIG. 3.

The container carrier 10 as described is preferably configured to permit folding the string of continuous container carriers 10 so that the resulting stack 40 lies relatively flat and horizontal within package 1, such as the carton shown in FIG. 1. The arrangement of the container carrier 10 including an unequal pitch or aperture length and a generally oval shaped dividing aperture 70 having tapered and minimally radiused ends results in easier and cleaner separation of container carriers 10 from the string.

In a preferred embodiment of the invention shown in FIG. 1, package 1 comprises a carton. The carton may contain one or more stacks 40 of container carriers 10. A method for assembling package 1 of container carriers 10 is required that results in an efficiently filled package 1 and permits uninterrupted removal of a mostly continuous elongated strip of container carriers 10. In one preferred embodiment of this invention, package 1 is simultaneously loaded with multiple stacks 40 of container carriers 10. Preferably, though not necessarily, each stack 40 of container carriers 10 is separated and/or positioned using one or more dividers to maintain position of and spacing between the various stacks 40 of container carriers 10. This configuration helps prevent tangling and other problems encountered during loading and unloading of package 1.

In a preferred embodiment of this invention, each additional stack 40 of container carriers 10 that is added to package 1 is connected to the previous stack 40 of container carriers 10. Preferably, an end container carrier at a bottom of a first stack 40 of container carriers 10 is connected with a beginning container carrier at a top of an additional stack 40 of container carriers 10. The end container carrier is preferably connected or spliced with the beginning container carrier using a weld attachment or a heat seal. Adjacent stacks 40 of container carriers 10 may also be connected using other methods known to those having skill in the art.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

The invention claimed is:

1. A container carrier for unitizing a plurality of containers comprising:

a flexible web forming a plurality of container receiving apertures arranged in longitudinal rows and transverse ranks, wherein each container receiving aperture in an inner rank includes a different length than each container receiving aperture in an outer rank, each container receiving aperture including a generally triangular shape having a generally arcuate base and a pair of concave sides that taper toward a center;

a dividing aperture formed only at an outer longitudinal extremity of each container receiving aperture of the outer rank, wherein the dividing aperture is generally oval shaped having two tapered ends, wherein the flexible web is foldable along the dividing aperture;

a plurality of additional container carriers connected to the longitudinal extremity of the container carrier to form a generally continuous string of container carriers; and a carton, wherein the generally continuous string of container carriers are fan folded within the carton.

2. The container carrier of claim 1 further comprising:

a flat segment formed in an outer corner of each container receiving aperture in the outer rank.

3. The container carrier of claim 1 further comprising:

a generally diamond shaped intermediate aperture formed in the flexible web between each rank of the transverse ranks of container receiving apertures.

4. The container carrier of claim 3 further comprising:

a generally crescent shaped grasping aperture formed in the flexible web on each side of each intermediate aperture.

5. The container carrier of claim 1 further comprising:

a reduced width of the flexible web along outer bands of each container receiving aperture.

6. The container carrier of claim 1 wherein the dividing aperture is centered within a first attachment area between adjacent container carriers.

7. A generally continuous string of container carriers, each container carrier for unitizing a plurality of containers, the generally continuous string of container carriers comprising:

a flexible web forming a plurality of container receiving apertures arranged in longitudinal rows and transverse ranks defining a single container carrier, wherein each container receiving aperture in an inner rank includes a different length than each container receiving aperture in an outer rank, each container receiving aperture including a generally arcuate base along an outer edge of the flexible web and a pair of concave sides that taper toward a center of the flexible web;

a dividing aperture formed only at an outer longitudinal extremity of each container receiving aperture of the outer rank between each adjacent single container carrier, wherein the generally continuous string of container carriers is foldable along the dividing aperture; and a carton wherein the generally continuous string of container carriers are fan folded within the carton.

8. The package of claim 7 wherein the generally continuous string of container carriers consists of a single layer of material.

9. The generally continuous string of container carriers of claim 7 further comprising:

a flat segment formed in an outer corner of each container receiving aperture in the outer rank.

10. The generally continuous string of container carriers of claim 7 further comprising:

a generally diamond shaped intermediate aperture formed in the flexible web between each rank of the transverse ranks of container receiving apertures.

11. The container carrier of claim 10 further comprising:

a generally crescent shaped grasping aperture formed in the flexible web on each side of each intermediate aperture.

12. The container carrier of claim 7 further comprising:

a reduced width of the flexible web along outer bands of each container receiving aperture.

* * * * *